US010495405B1

(12) United States Patent
Ma

(10) Patent No.: US 10,495,405 B1
(45) Date of Patent: Dec. 3, 2019

(54) MAGAZINE FOR A TOY GUN

(71) Applicant: Buzz Bee Toys (HK) Co., Limited, Kowloon (HK)

(72) Inventor: Chor Ming Ma, Kowloon (HK)

(73) Assignee: BUZZ BEE TOYS (HK) Co., Limited, Kowloon (HK)

( * ) Notice: Subject to any disclaimer, the term of this patent is extended or adjusted under 35 U.S.C. 154(b) by 0 days.

(21) Appl. No.: 16/052,713

(22) Filed: Aug. 2, 2018

(51) Int. Cl.
*F41B 11/00* (2013.01)
*F41B 11/54* (2013.01)
*F41B 7/08* (2006.01)
*F41B 11/646* (2013.01)

(52) U.S. Cl.
CPC ..... *F41B 11/54* (2013.01); *F41B 7/08* (2013.01); *F41B 11/646* (2013.01)

(58) Field of Classification Search
CPC ..... F41B 11/54
See application file for complete search history.

(56) References Cited

U.S. PATENT DOCUMENTS 4,658,700 A * 4/1987 Sullivan ..... F41A 9/73 89/33.02
6,109,252 A * 8/2000 Stevens ..... F41B 11/53 124/48
6,889,680 B2 * 5/2005 Christopher ..... F41B 11/53 124/51.1
8,839,706 B1 * 9/2014 Macy ..... F41B 11/54 124/45
2006/0042613 A1 * 3/2006 Hu ..... F41B 11/54 124/48
2010/0293830 A1 * 11/2010 Winge ..... F41A 9/02 42/49.01
2011/0253119 A1 * 10/2011 Cho ..... F41B 11/54 124/41.1
2018/0202749 A1 * 7/2018 Sullivan ..... F41B 11/54

* cited by examiner

*Primary Examiner* — John A Ricci

(57) ABSTRACT

The invention relates to magazine for a toy gun, comprising: a housing having an elongated first housing portion and a cylindrical second housing portion which together define a passageway for receiving a plurality of projectiles; the first housing portion being configured for accommodating received projectiles in a substantially linear part of said passageway, and the second housing portion being configured for accommodating the received projectiles in a substantially circular part of said passageway extending about a central axis of the second housing portion; a discharge opening for discharging said received projectiles; and a resilient member arranged centrally of the second housing portion, wherein said resilient member is adapted to apply a torsional force to move said received projectiles from the circular part to the linear part of the passageway. The invention also relates to a toy gun having the magazine as described.

27 Claims, 24 Drawing Sheets

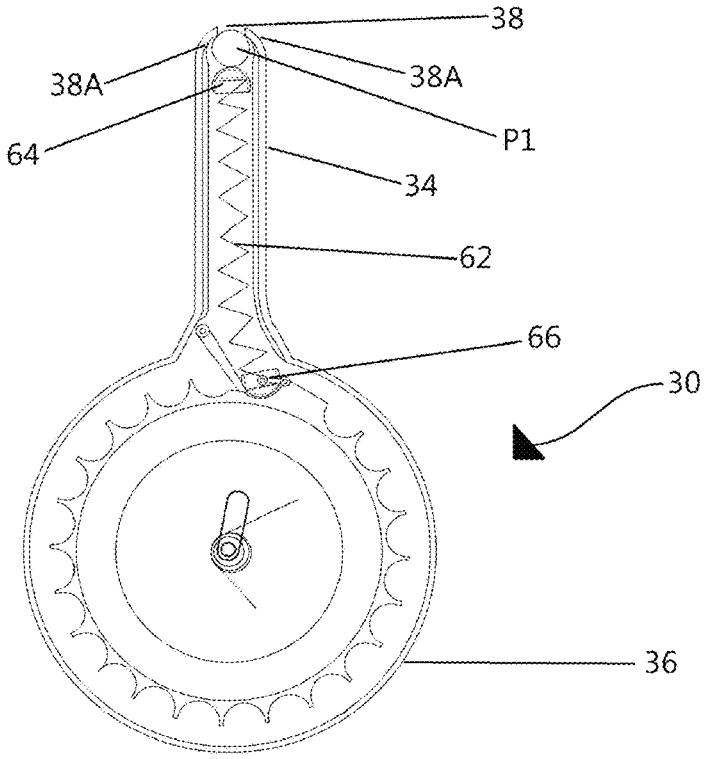
FIG. 4A(i)
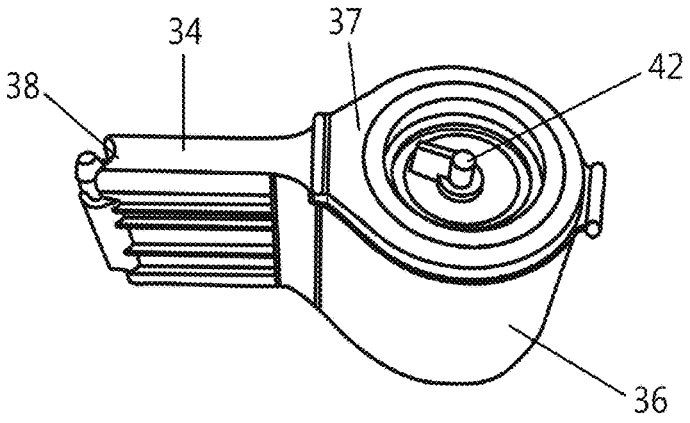
FIG. 4A(ii)

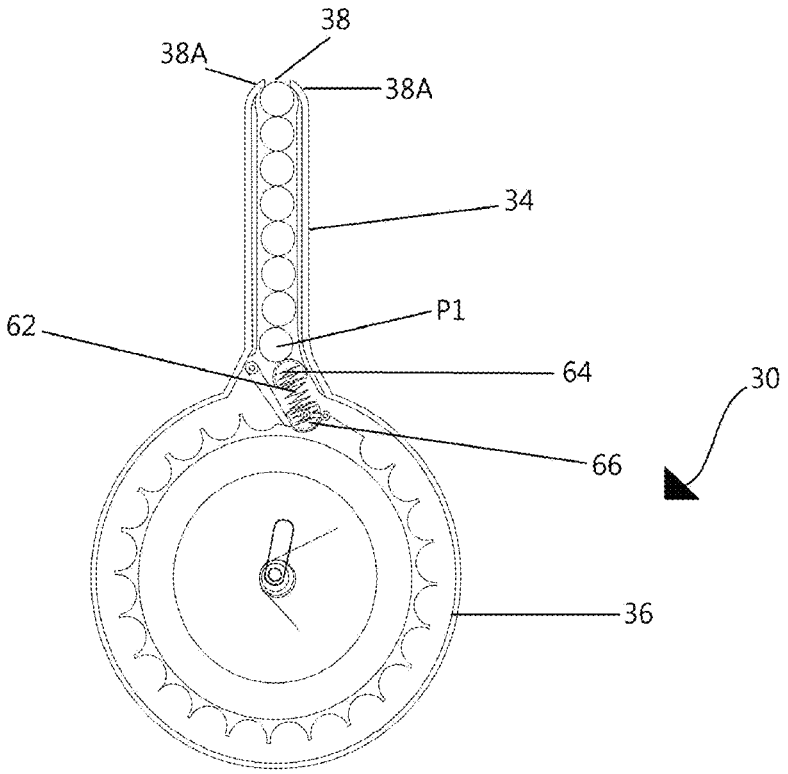
FIG. 4B(i)
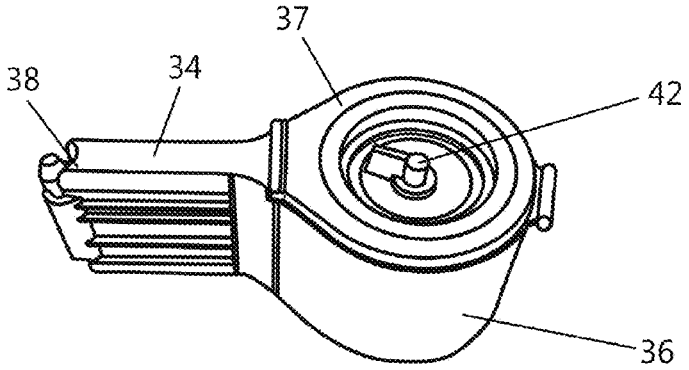
FIG. 4B(ii)

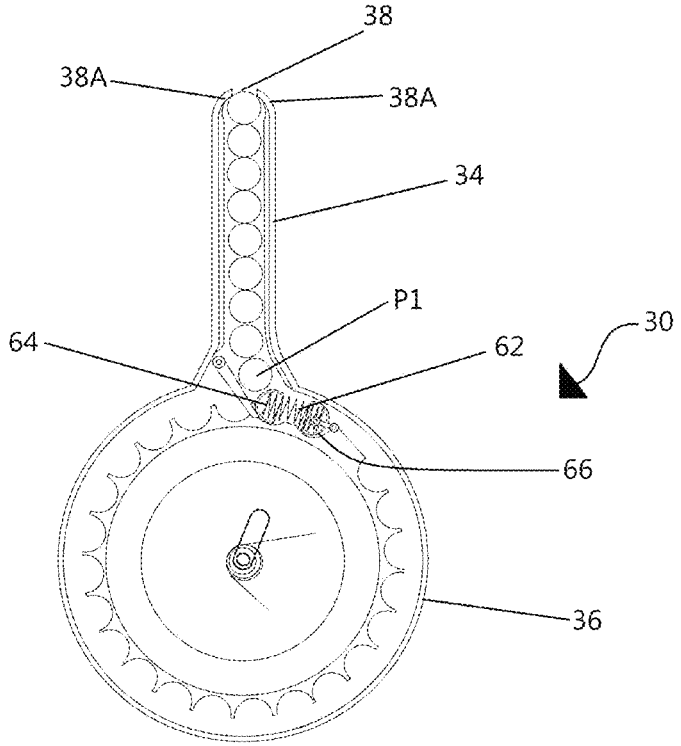
FIG. 4C(i)
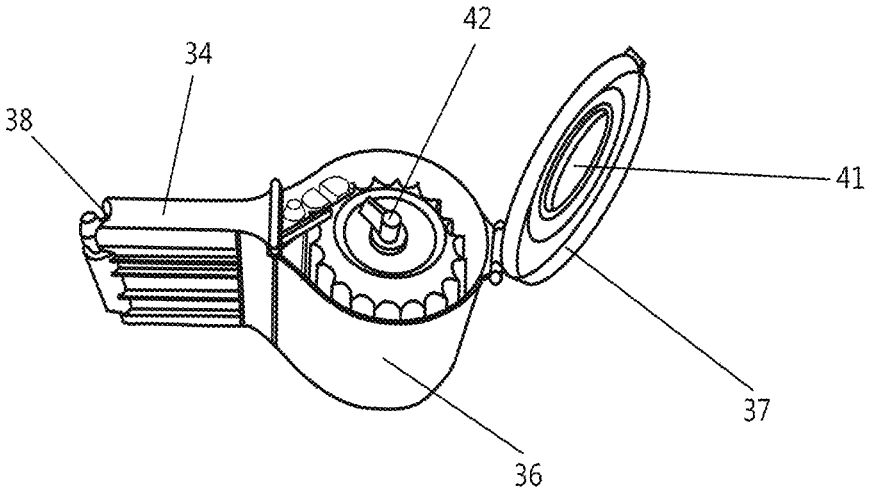
FIG. 4C(ii)

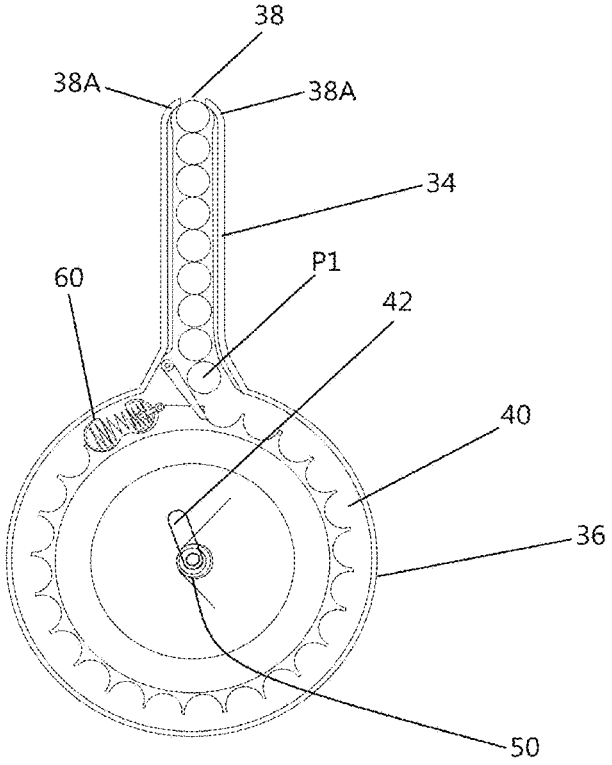
FIG. 4D(i)
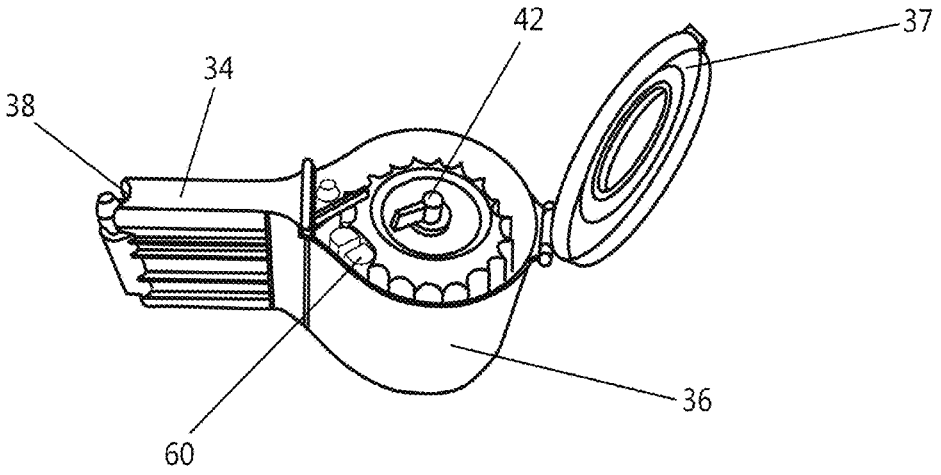
FIG. 4D(ii)

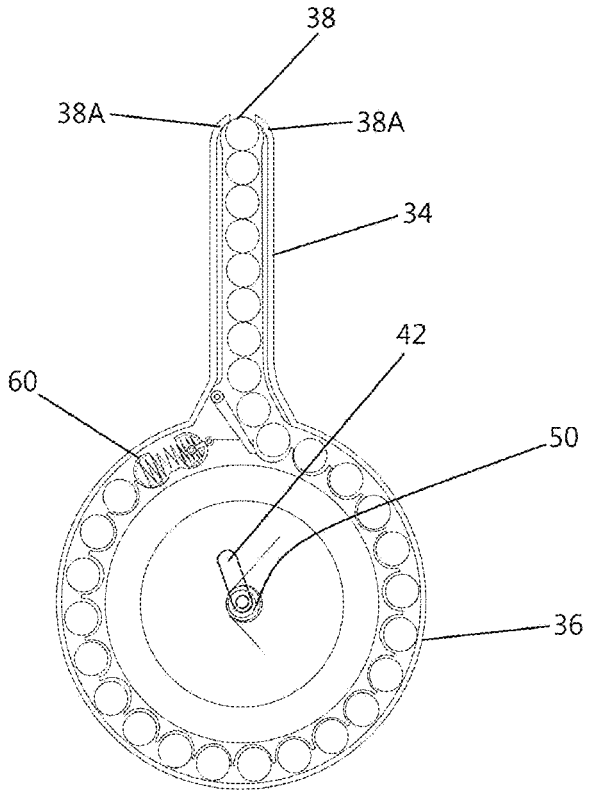
FIG. 4E(i)
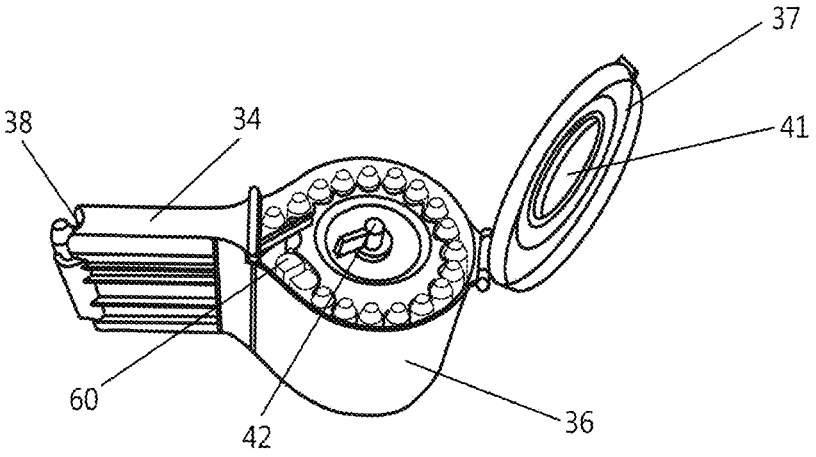
FIG. 4E(ii)

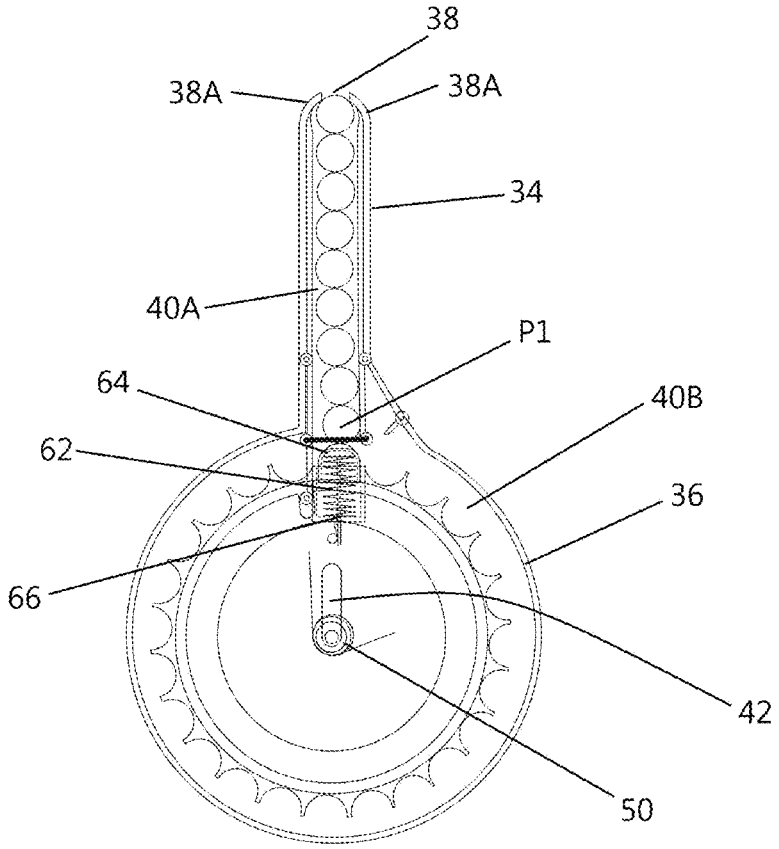
FIG. 7A(i)
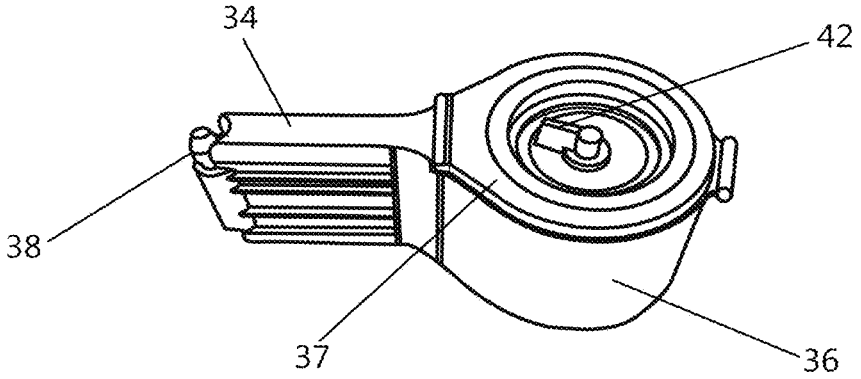
FIG. 7A(ii)

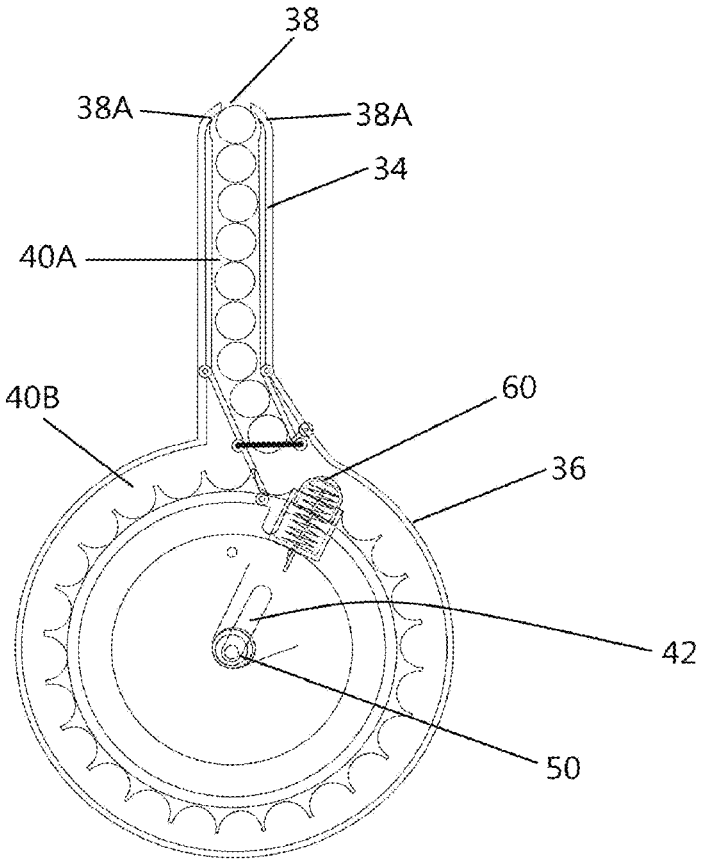
FIG. 7B(i)
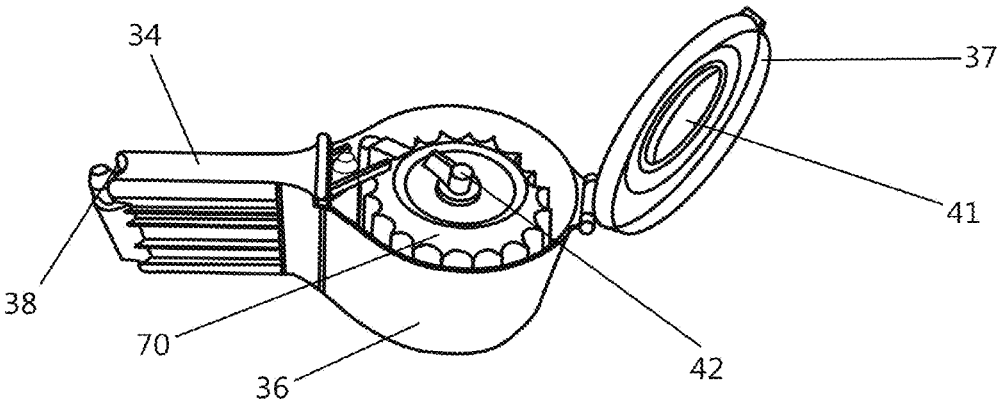
FIG. 7B(ii)

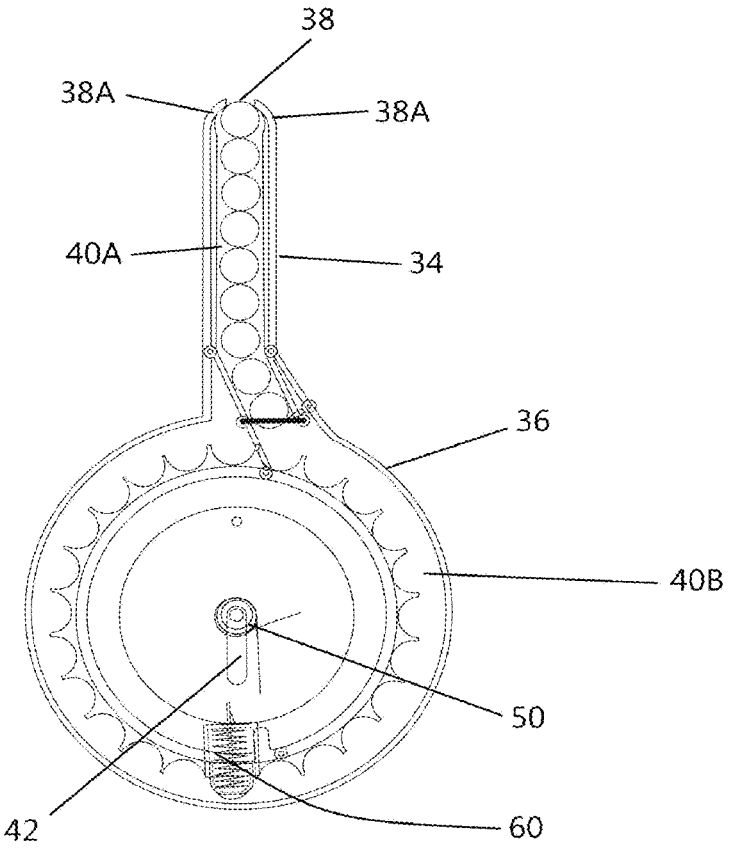
FIG. 7C(i)
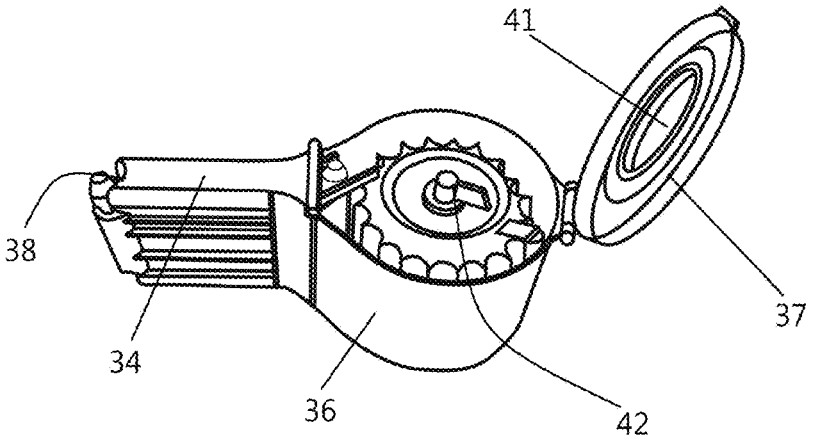
FIG. 7C(ii)

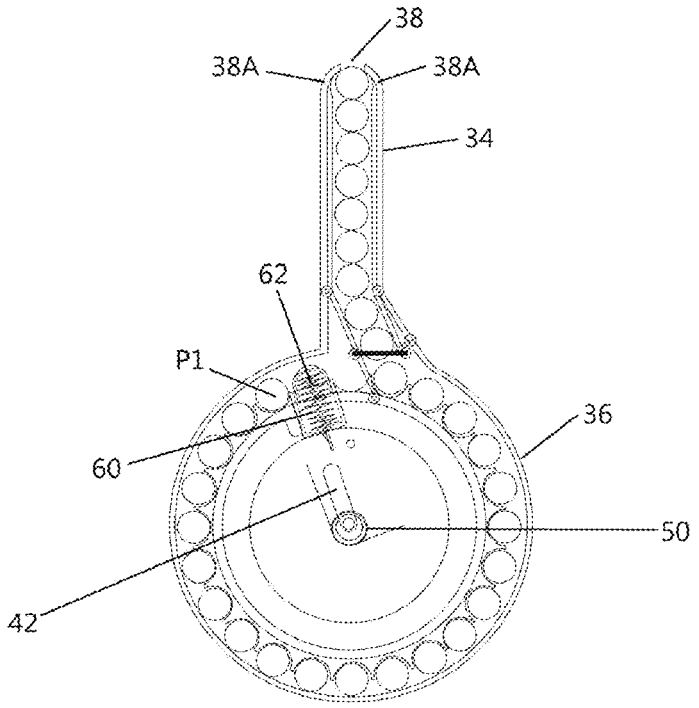
FIG. 7D(i)
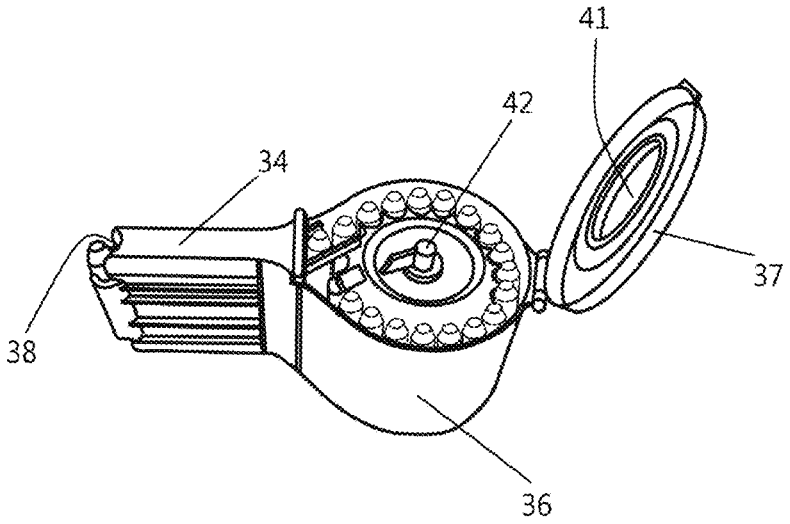
FIG. 7D(ii)

MAGAZINE FOR A TOY GUN

FIELD OF THE INVENTION

The invention relates to a toy and, particularly, but not exclusively, to a magazine for use in a toy for launching projectiles such as a toy gun.

BACKGROUND OF THE INVENTION

A variety of projectile firing toys such as, but not limited to, toy guns of various types are available in the market. Particularly, toy guns have been designed with both decorative and functional features to mimic the appearance, operation as well as a user's experience of real firearms. For example, toy guns have been developed with magazines of different forms such as cartridge magazines or drum magazines for loading, storing and discharging of toy projectiles so as to simulate the action of a real firearm such as a rifle or a machine gun. Various features have also been incorporated into these toy magazines aiming to enhance the user's experience.

OBJECTS OF THE INVENTION

An object of the present invention is to provide a novel toy gun magazine for receiving, accommodating and discharging projectiles.

A further object of the present invention is to mitigate or obviate to some degree one or more problems associated with known magazine for toy projectiles, or at least to provide a useful alternative.

The above objects are met by the combination of features of the main claim; the sub-claims disclose further advantageous embodiments of the invention.

One skilled in the art will derive from the following description other objects of the invention. Therefore, the foregoing statements of object are not exhaustive and serve merely to illustrate some of the many objects of the present invention.

SUMMARY OF THE INVENTION

In a first main aspect, the invention provides a magazine for a toy gun. The magazine comprises a housing having a first housing portion and a second housing portion which together define a passageway for receiving a plurality of projectiles; the first housing portion being configured for accommodating received projectiles in a substantially linear part of said passageway, and the second housing portion being configured for accommodating received projectiles in a substantially circular part of said passageway extending about a central axis of the second housing portion; the first housing portion having a discharge opening for discharging said received projectiles; and a resilient member arranged centrally of the second housing portion, wherein said resilient member is adapted to apply a torsional force to move said received projectiles from the circular part of the passageway in the second housing portion to the linear part of the passageway in the first housing portion.

In a second main aspect, the invention provides a toy gun comprising the magazine according to the first aspect. The toy gun further comprises a receiving portion at a body of the toy gun for releasably receiving at least part of the first housing portion of the magazine.

In a third main aspect, the invention provides a method of preparing the magazine according to the first aspect. The method comprises the steps of providing a housing having a first housing portion and a second housing portion which together define a passageway for receiving a plurality of projectiles; the first housing portion being configured for accommodating received projectiles in a substantially linear part of said passageway, and the second housing portion being configured for accommodating received projectiles in a substantially circular part of said passageway extending about a central axis of the second housing portion; providing a discharge opening for discharging the received projectiles at the first housing portion; and arranging a resilient member centrally at the second housing portion to apply a torsional force to move said received projectiles from the circular part of the passageway in the second housing portion to the linear part of the passageway in the first housing portion.

The summary of the invention does not necessarily disclose all the features essential for defining the invention; the invention may reside in a sub-combination of the disclosed features.

BRIEF DESCRIPTION OF THE DRAWINGS

The foregoing and further features of the present invention will be apparent from the following description of preferred embodiments which are provided by way of example only in connection with the accompanying figure, of which:

FIGS. 4A to 4E show a third embodiment of the magazine in accordance with the present invention;

FIG. 4A(i) is a front, internal view showing a third embodiment of the magazine in accordance with the present invention;

FIG. 4A(ii) is a perspective view showing the magazine of FIG. 4A(i);

FIG. 4B(i) is a front, internal view showing the magazine of FIG. 4A(i) with the pushing member being compressed by the loaded projectiles;

FIG. 4B(ii) is a perspective view showing the magazine of FIG. 4B(i);

FIG. 4C(i) is a front, internal view showing the magazine of FIG. 4B(i) with the pushing member being pushed further down into the second housing portion by the loaded projectiles;

FIG. 4C(ii) is a perspective view showing the magazine of FIG. 4C(i) with the cover member in an opened configuration;

FIG. 4D(i) is a front, internal view showing the magazine of FIG. 4C(i) with the positioning means being manually rotated via the knob such that the pushing member is made to separate from the loaded projectiles;

FIG. 4D(ii) is a perspective view showing the magazine of FIG. 4D(i);

FIG. 4E(i) is a front, internal view showing the magazine of FIG. 4D(i) after the positioning means being directly filled with more projectiles.

FIG. 4E(ii) is a perspective view showing the magazine of FIG. 4E(i);

FIGS. 7A to 7H show a fourth embodiment of the magazine in accordance with the present invention.

FIG. 7A(i) is a front, internal view showing a fourth embodiment of the magazine in accordance with the present invention;

FIG. 7A(ii) is a perspective view showing the magazine of FIG. 7A(i);

FIG. 7B(i) is a front, internal view showing the magazine of FIG. 7A(i) with the positioning means being manually rotated via the knob such that the pushing member is made to separate from the loaded projectiles;

FIG. 7B(ii) is a perspective view showing the magazine of FIG. 7B(i) with the cover member in an opened configuration;

FIG. 7C(i) is a front, internal view showing the magazine of FIG. 7B(i) with the positioning means being manually rotated further such that the pushing member is made to further separate from the loaded projectiles;

FIG. 7C(ii) is a perspective view showing the magazine of FIG. 7C(i);

FIG. 7D(i) is a front, internal view showing the magazine of FIG. 7C(i) after the positioning means being directly filled with more projectiles;

FIG. 7D(ii) is a perspective view showing the magazine of FIG. 7C(i).

DESCRIPTION OF PREFERRED EMBODIMENTS

The following description is of preferred embodiments by way of example only and without limitation to the combination of features necessary for carrying the invention into effect.

Reference in this specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Figure 1:
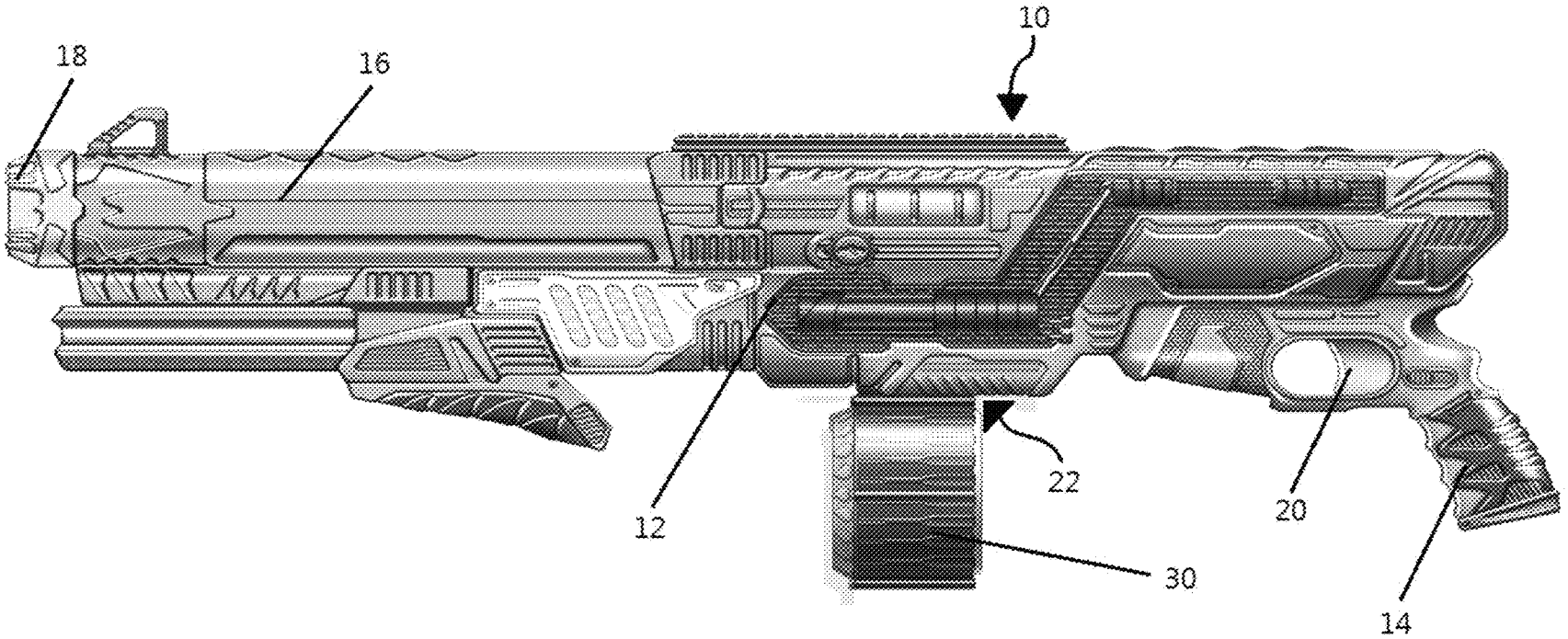
FIG. 1 is a side view of a toy gun having a magazine in accordance with an embodiment of the present invention.

Referring to FIG. 1, shown is a projectile firing toy in the form of a toy gun 10 according to an embodiment of the present invention. The toy gun 10 is generally configured with a gun body 12 having a hand grip 14, a barrel 16, a muzzle 18 arranged at the end of the barrel 16, and a trigger 20 for triggering launching of a projectile from the barrel 16. Particularly, the toy gun 10 comprises a magazine 30 for receiving and accommodating one or more projectiles. In this embodiment, the magazine 30 is configured to releasably connect to the gun body 12 via, for example, a receiving portion 22 located at a bottom side of the gun body 12. The releasable connection of the magazine 30 to the toy gun 10 allows feeding of the received projectiles from the magazine 30 to the gun body 12 for firing, and also allows detachment of the magazine 30 from the gun body 12 for reloading of projectiles and/or replacing an emptied magazine with a new one by a user.

Figure 2A:
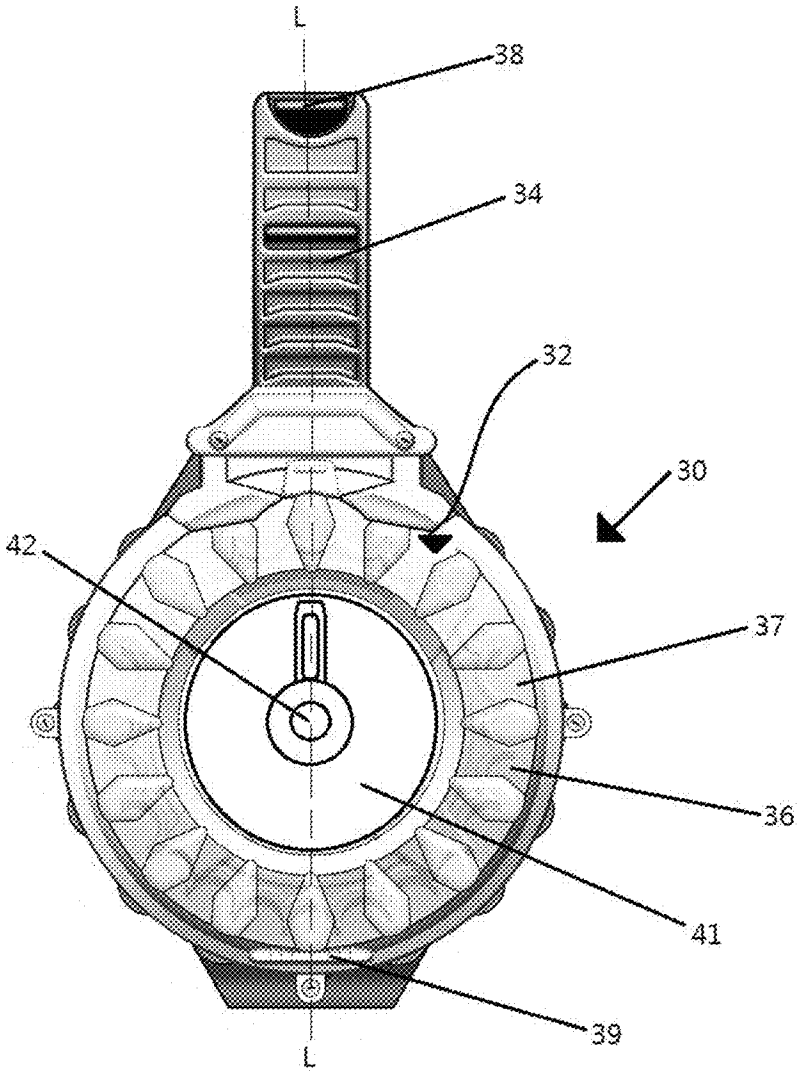
FIG. 2A is a front view of the magazine of FIG. 1.
Figure 2B:
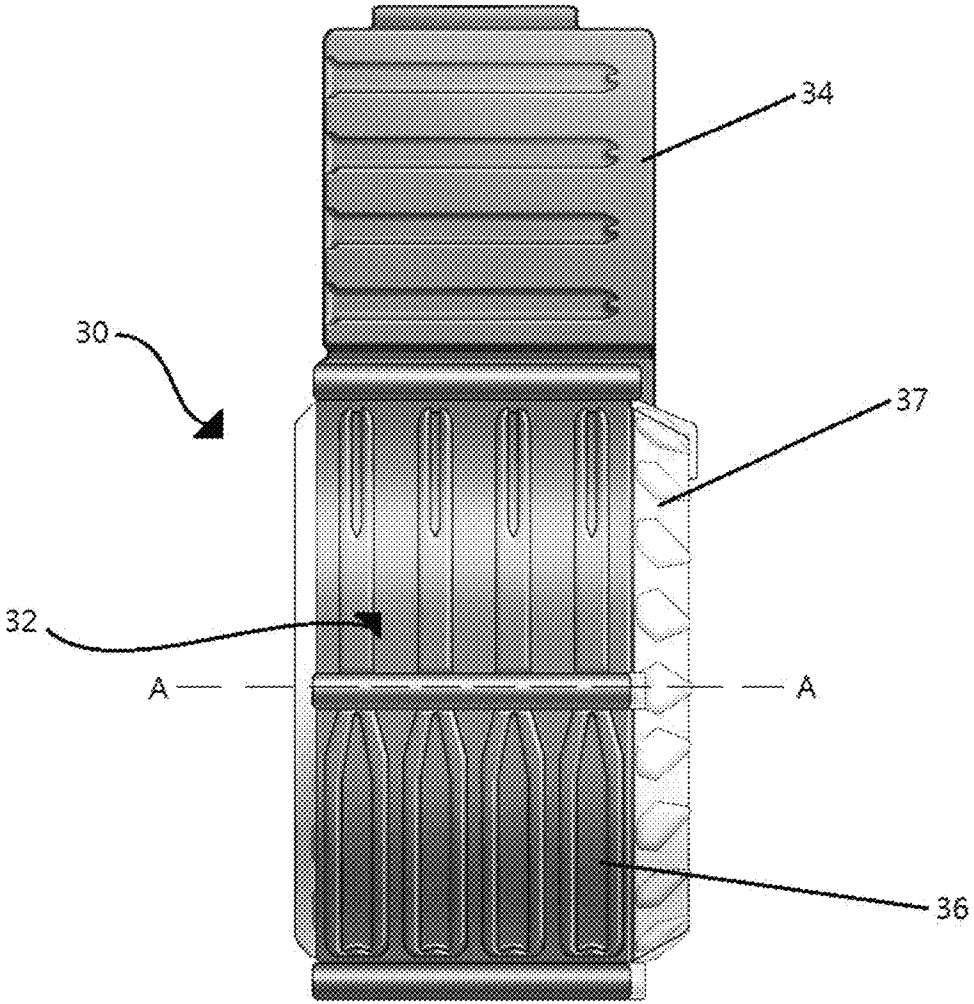
FIG. 2B is a side view of the magazine of FIG. 1.

FIGS. 2A and 2B, respectively, show a front view and side view of the magazine 30. In this embodiment, the magazine 30 comprises a housing 32 having a first housing portion 34 connected to a second housing portion 36. As illustrated in the figures, the first housing portion 34 preferably comprises an elongated housing which may be substantially rectangular in shape, and that the second housing portion 36 comprises a drum-like housing which may be substantially cylindrical in shape.

Preferably, the first, rectangular housing portion 34 of the housing 32 is configured to comprise a discharge opening 38 at an end distal to the second, cylindrical housing portion 36, the discharge opening 38 for receiving projectiles and for discharging the received projectiles. The housing 32 may further comprise a cover member 37 arranged to cover at least part of the housing 32, such as the second housing portion 36. In one embodiment, the cover member 37 is pivotally connected to the housing 32 via, for example, a hinge connection 39, such that the cover member 37 is openable to allow direct loading and/or unloading of projectiles to and/or from the second housing portion 36. In one further embodiment, the magazine 30 may comprise a switch or a knob 42 actuatable to manually adjust movement of the received projectiles within the second housing portion 36. The cover member 37 may optionally be configured to comprise an opening 41, such as a central opening as shown in the drawings, which allows the knob 42 to be easily accessible when the second housing portion 36 is closed by the cover member 37.

Without being limited by the specific configurations of the housing 32 described, the first housing portion 34 and the second housing portion 36 can actually be configured and constructed in any other possible and applicable manners, as long as the two housing portions 34, 36 of the housing 32 are connected to define a continuous passageway 40 for receiving a plurality of projectiles, and that the received projectiles are sequentially movable along the passageway 40. For example, the first and the second housing portions 34, 36 can be connected such that the longitudinal axis L-L of the first housing portion 34 crosses the central axis A-A of the second housing portion 36, as shown in FIGS. 2A and 2B. In another embodiment, the first housing portion 34 can be tangentially connected with the second housing portion 36, as shown in FIGS. 3A to 3D. Preferably, the first housing portion 34 is configured to accommodate the received projectiles in a substantially linear part 40A of the passageway 40, and the second housing portion 36 is configured to accommodate the received projectiles in a substantially circular part 40B of the passageway 40, with the circular part 40B extending about the central axis A-A of the second housing portion 36. Again, the present invention should not be limited to any specific embodiments as described or illustrated. A skilled person should readily understand that any variations or alternative arrangements of the first and the second housing portions 34, 36 should also be encompassed, as long as the housing portions are capable of performing the required technical functions without departing from the spirit of the present invention.

To facilitate movement of the projectiles along the passageway 40 in the housing 32 and particularly, the second housing portion 36, a resilient member 50 is arranged centrally at the second housing portion 36. In this embodiment, the resilient member 50 is adapted to apply a torsional force to move the received projectiles from the circular part 40B of the passageway 40 in the second housing portion 36 to the linear part 40A of the passageway 40 in the first housing portion 34. The resilient member 50 may comprise, for example, any traditional torsion springs which store energy upon twisting.

In one embodiment, movement of the received projectiles within the second housing portion 36 can be assisted by a positioning means 70 arranged to position and to move the received projectiles at the second housing portion 36. The positioning means 70, which can be configured in the form of, or to comprise, a wheel member 72, is rotatable about the central axis A-A of the second housing portion 36. Preferably, the wheel member 72 may further comprise a receiving portion 74 having a plurality of recesses arranged around the circumferential edge of the wheel member 72 for receiving one or more projectiles, with each of the recesses being configured to conform with the shape of a surface portion of a projectile, as shown in FIGS. 3A to 3D. The positioning means 70 is preferred to operably connect with the centrally arranged resilient member 50, such that the positioning means 70 is movable by the torsional force of the resilient member 50 thereby causing the received projectiles to move along the circular part 40B of the passageway 40.

In another embodiment, a pushing member 60 may be arranged in the passageway 40 for urging the received projectiles at the first housing portion 34 towards the discharge opening 38. Specifically, the pushing member 60 is movably arranged at the passageway 40 to abut a first projectile P1 received in the passageway 40, as shown in FIGS. 3A to 3D. Preferably, the pushing member 60 comprises a resilient means 62 adapted to apply a biasing force towards the first received projectile P1 to thereby urge the aligned, received projectiles towards the discharge opening 38. In one embodiment, the resilient mean 62 is preferred to be linearly extendable and, more preferably, to be linearly extendable over all or a part of the length of the linear part 40A of the passageway 40 of the first housing portion 34.

For one embodiment in which the pushing member 60 is absent, the torsion spring of the resilient member 50 is adapted to act independently to apply the torsional force to rotate the positioning means 70 and thus to move the received projectiles along the passageway 40. This is practicable when, for example, the first housing portion 34 of the housing 32 is sufficiently short such that movement of the projectiles by the positioning means 70 under the torsional force is sufficient to push the aligned projectiles towards the discharge opening 38.

For embodiments where the pushing member 60 is present, the torsion spring of the resilient member 50 is adapted to act independently of the pushing member 60 to apply the torsional force to rotate the positioning means 70. Likewise, the pushing member 60 acts independently from the resilient member 50. By "to act independently" is meant that the resilient member 50 and the pushing member 60 are not mechanically linked or mechanically connected. However, in embodiments where both the resilient member 50 and the pushing member 60 are present, their independent actions in combination considerably improve the discharge of projectiles from the discharge opening 38 of the magazine.

Figure 3A:
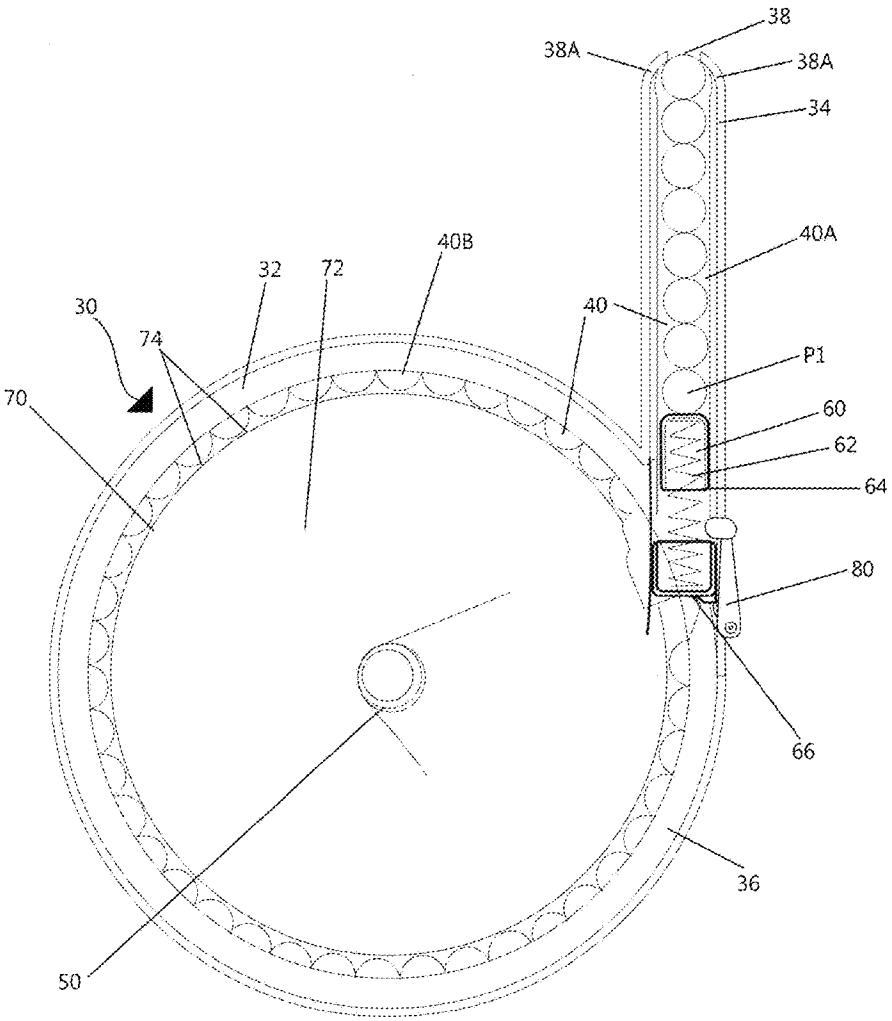
FIGS. 3A to 3D are front, internal views showing a second embodiment of the magazine in accordance with the present invention.

FIGS. 3A to 3D further show the relevant projectile loading steps into the housing 32 of an embodied magazine 30. A plurality of projectiles can be inserted, one at a time, into the linear part 40A of the passageway 40 of the first housing portion 34 via the end opening 38, with the first received projectile P1 abutting a pusher head 64 of the pushing member 60 under the resilient action of the resilient means 62 of the pushing member 60. As shown in FIG. 3A, the resilient means 62 of the pushing member 60 is adapted to be in an at least a partially extended condition when the pushing member 60 is at least partially located in the linear part 40A of the first housing portion 34, such that, under this condition, only the pushing member 60 urges the received projectiles towards the discharge opening 38 when the pushing member 60 is in its partially extended condition. In this embodiment, at least part of the pushing member 60, such as the pushing base 66, is positioned at the positioning means 70 such that the pushing member 60 is movable in response to rotation of the positioning means 70.

Figure 3B:
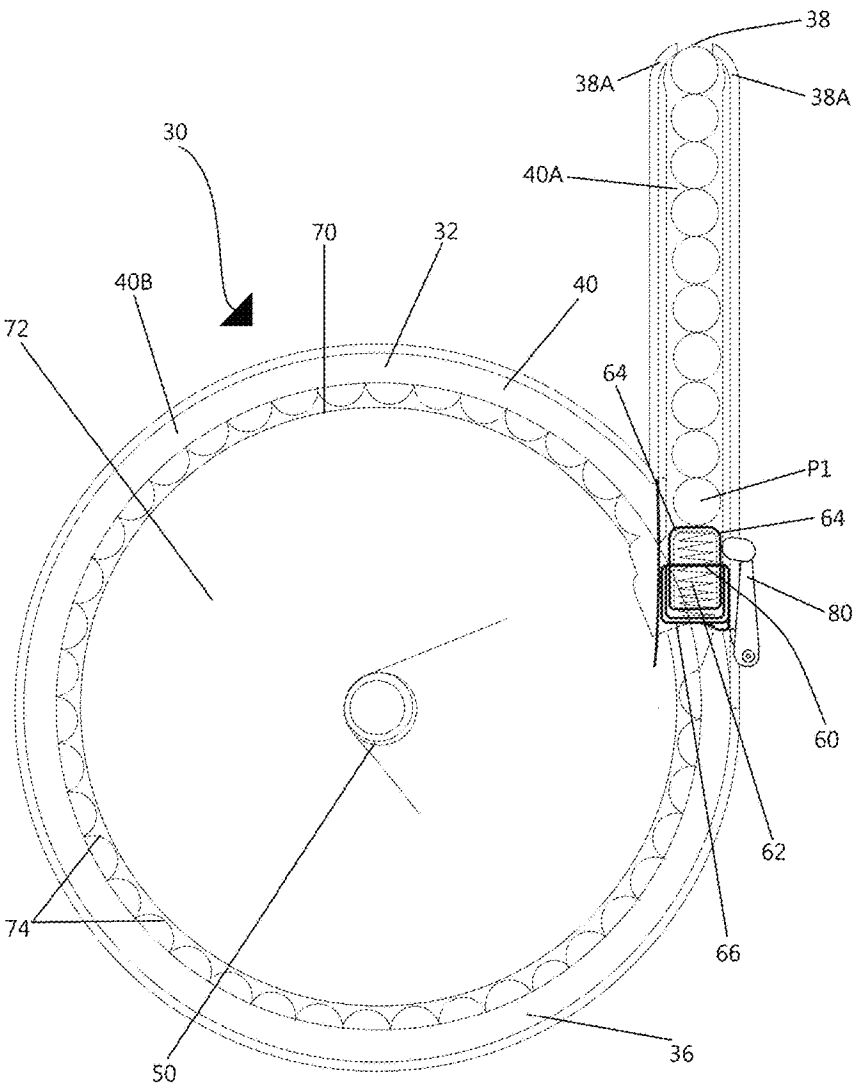
Figure 3C:
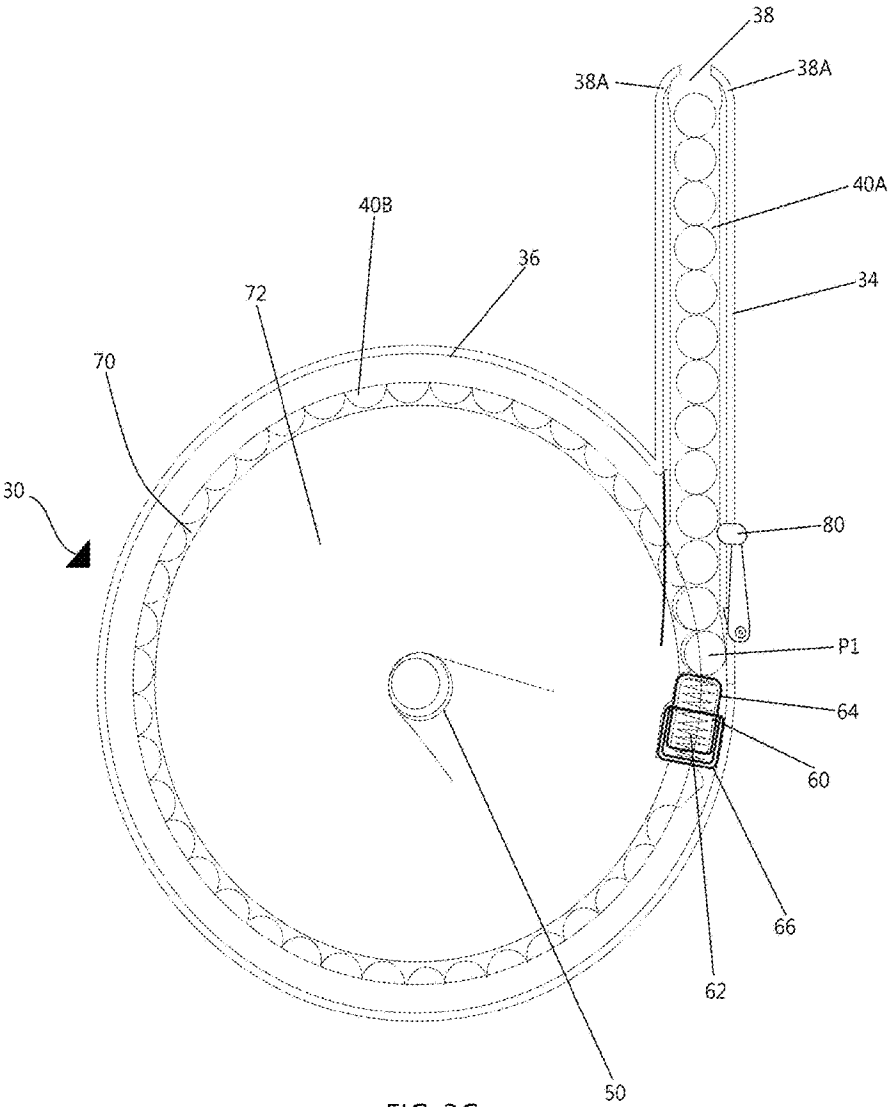
Figure 3D:
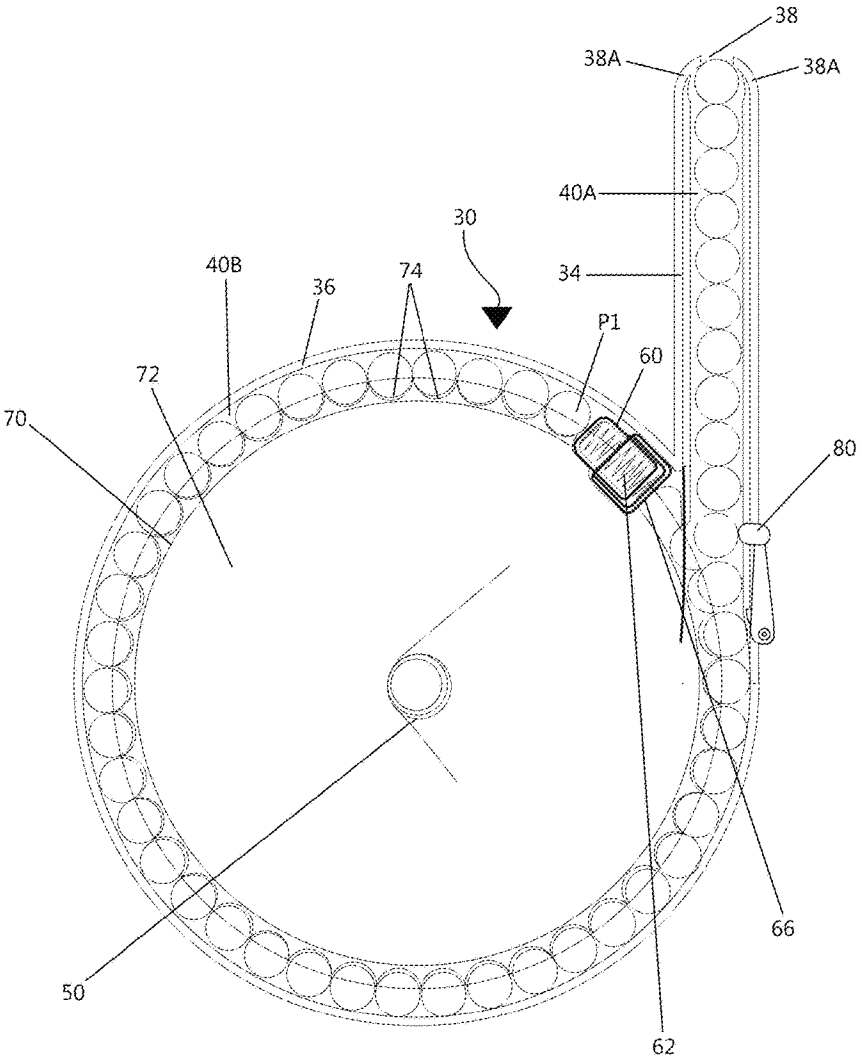

When the first housing portion 34 is to be filled with more projectiles via the opening 38, the resilient means 62 of the pushing member 60 will continue to be compressed until it reaches or exceeds a predetermined threshold, such as, for example, a full compression, as shown in FIG. 3B. Further insertion of projectiles into the first housing portion 34 then causes the pushing member 60 to move into the circular part 40B of the passageway 40, for example, in a clockwise manner as shown in FIG. 3C, during which the resilient means 62 of the pushing member 60 remains in its fully compressed state. Movement of the compressed pushing member 60 into the circular part 40B further causes the positioning means 70 to rotate, which in turn, twists and loads the torsion spring of the centrally located resilient member 50, as shown in FIGS. 3C and 3D.

It is important to note that the torsion spring of the resilient member 50 will not come into operation until the resilient means 62 of the pushing member 60 is compressed to the predetermined threshold, that is, preferably, a full compression of the resilient means 62. Optionally, a switch member 80 can be provided at the housing 32 to prevent operation of the torsion spring of the resilient member 50 prior to the resilient means 62 of the pushing member 60 being fully compressed. Once the resilient means 62 of the pushing member 60 has reached the required threshold and has moved into the circular part 40B of the passageway 40, the torsion spring of the resilient member 50 then becomes independently operable. In one specific embodiment, it is preferred that the biasing force of the resilient means 62 of the pushing member 60 when fully compressed is weaker than or equal to the torsional force of the torsion spring of the resilient member 50 when fully compressed. In some embodiments, the spring constant of the resilient means 62 of the pushing member 60 is less than or equal to the spring constant of the torsion spring of the resilient member 50.

The loaded torsion spring is then ready to apply a torsional force in a counter-clockwise direction to cause the positioning means 70 to push the received projectiles from the circular part 40B to the linear part 40A of the passageway and eventually to discharge the received projectiles one by one from the discharge opening 38 under the resilient action of the resilient means 62 of the pushing member 60. Particularly, once the pushing member 60 re-enters the linear part 40A of the passageway 40 upon movement of the received projectiles from the first housing portion 34, the resilient means 62 of the pushing member 60 is adapted to extend such that the pushing head in continuence of its to abutment on the first received projectile P1 applies a linear resilient force to urge the remaining received projectiles along the linear part 40A of the passageway towards the end opening 38 for discharge therefrom.

In one embodiment, the discharge opening 38 preferably comprises a gate member 38A configured to prevent the received projectiles from exiting the first housing portion 34 via the opening 38, unless the magazine 30 is connected with a toy gun for discharge. More preferably, the gate member 38A may comprise a pair of curved arms adapted to withstand the biasing force from the resilient means 62 of the pushing member 60 when the magazine is not connected to a toy gun or the like.

Referring to FIGS. 4A to 4E, shown is another embodiment of the magazine 30 according to the present invention. Unlike the previous embodiment shown in FIGS. 3A to 3D, the first and the second housing portions 34, 36 of this embodiment are non-tangentially connected in that the first housing portion 34 meets the second housing portion 36 at a centre-point of a side surface thereof. Specifically, FIGS. 4A(i), 4B(i) and 4C(i) illustrate the loading of projectiles into the first housing portion 34, during which the resilient means 62 of the pushing member 60 is compressed from a partially compressed state (see FIG. 4A(i)) to a fully compressed state (see FIGS. 4B(i) and 4C(i)). Preferably, the pushing member 60 in its fully compressed state is adapted to be positioned, received or engaged at one or more recesses of the recess portion 74 of the wheel member 72, such that further movement of the pushing member 60 towards the second housing portion 36 caused by the incoming projectiles will in turn push the positioning means 70 into rotation, for example, in a clockwise direction about the central axis A-A. Rotation of the position means 70 may then twist the centrally arranged resilient member 50 to load its torsion spring, and thus to generate a torque acting in an opposing direction. FIGS. 4A(ii), 4B(ii) and 4C(ii) further show the corresponding perspective views of the magazine 30 of FIGS. 4A(i), 4B(i) and 4C(i), with the cover member 37 arranged in a closed configuration in FIGS. 4A(ii) and 4B(ii), and with the cover member 37 in an opened configuration in FIG. 4C(ii). In one embodiment, the cover member 37 is configured such that it is openable only after the pushing member 60 has entered the circular part 40B of the passageway 40 of the second housing portion 36.

Preferably, the magazine 30 may further comprise a knob 42 actuatable to adjust movement of the received projectiles in the passageway 40. More preferably, the knob 42 is manually actuatable to turn the wheel or the positioning means 70 into rotation regardless of the state of the resilient member 50 and thus is capable of overcoming the torsional force applied by the resilient member 50. As shown in FIGS. 4D(i) and 4D(ii), for example, the knob 42 can be actuated by manually turning the knob 42 to rotate the positioning means 70 in a clockwise direction such that the pushing member 60 is made to separate from and thus no longer abuts the first received projectile P1. This manual rotation of the positioning means 70 creates more projectile-accommodating spaces in between P1 and the pushing member 60, such that direct filling of projectiles into the second housing portion 36 by the user, instead of the one by one insertion of the projectiles from the opening 38, is made possible. FIGS. 4E(i) and 4E(ii) illustrate the second housing portion 36 after the direct filling of the projectiles at the positioning means 70.

Figure 5A:
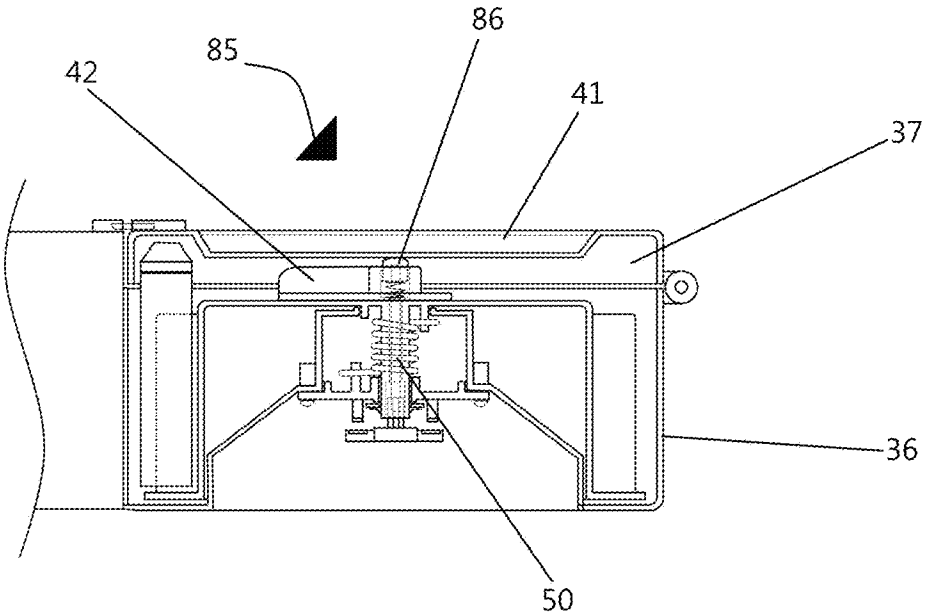
FIGS. 5A and 5B show a clutch mechanism of a magazine in accordance with an embodiment of the present invention, with the clutch mechanism being in its released and engaged conditions, respectively.
Figure 5B:
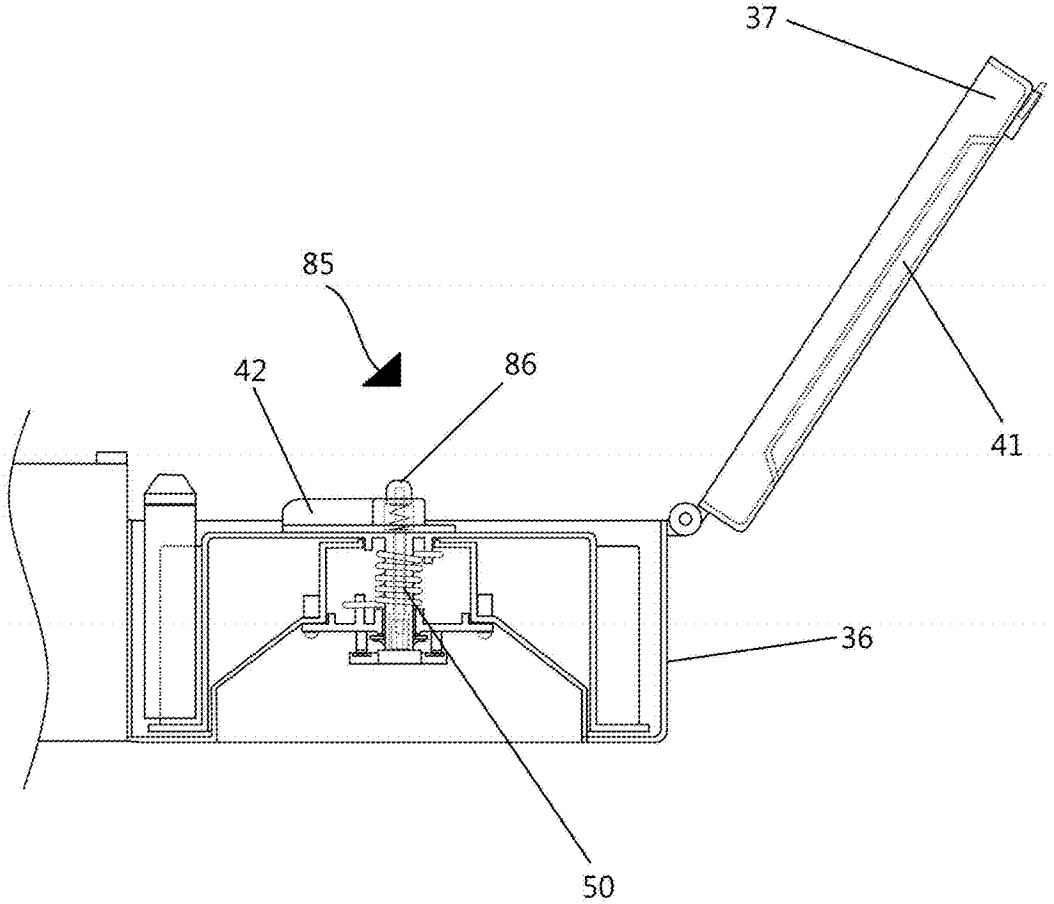
Figure 6A:
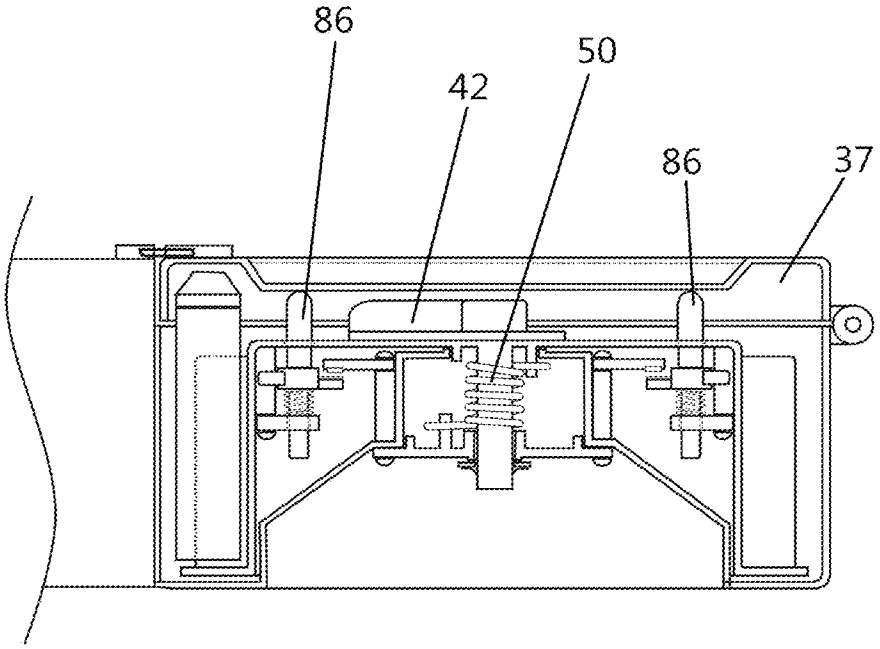
FIGS. 6A and 6B show another embodiment of the clutch mechanism.
Figure 6B:
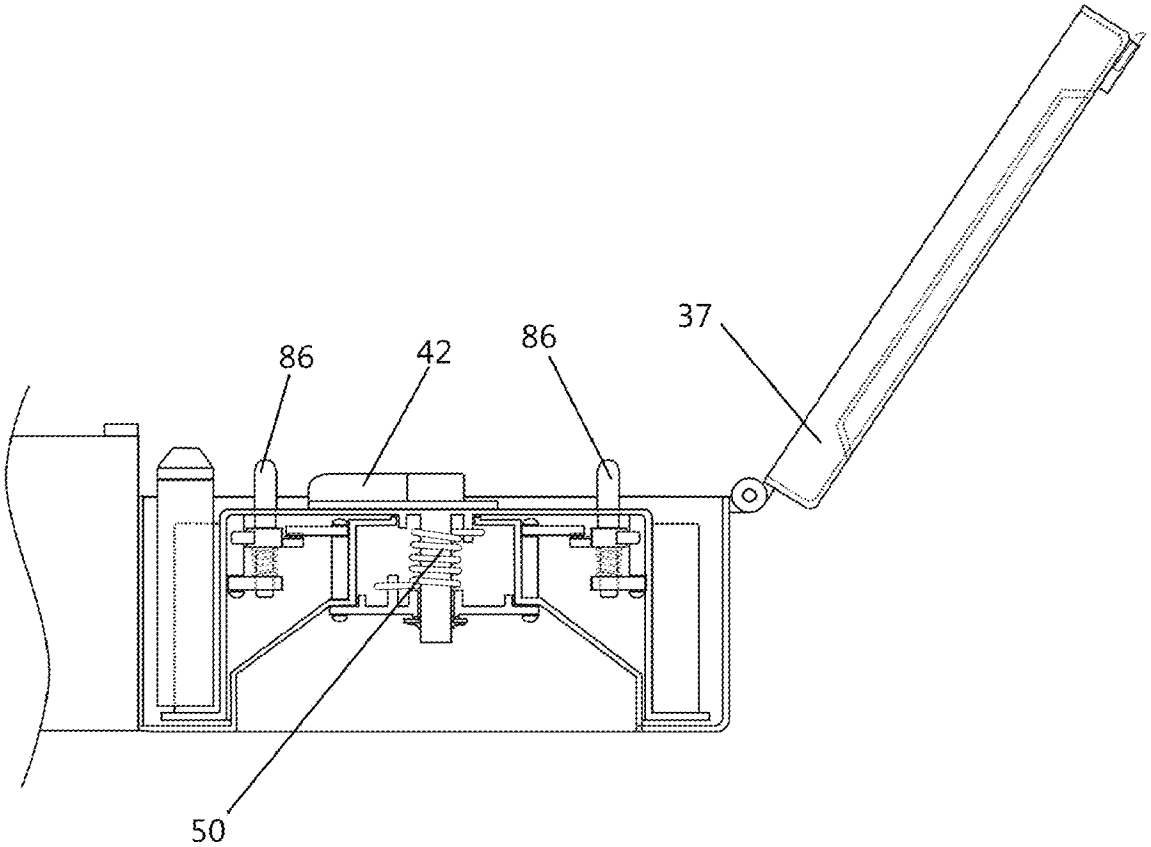

In one embodiment, the knob 37 is preferred to be connected with the resilient member 50 with a clutch mechanism 85. As illustrated in FIGS. 5A and 5B, the clutch mechanism 85 comprises a button 86 engageable by the cover member 37. The button 86 is preferred to be positioned at an upper side of the second housing portion 36, for example, at the center of the knob 42, such that the button 86 can be readily pressed upon by the cover member 37 when the cover member 37 is closed. However, it will be understood that the button 86 can be provided at any other location of the housing 32. For example, the button 86 can be provided in the form of two pin members 86 spaced from the knob 42, as shown in the embodiment of FIGS. 6A and 6B.

In the embodiment as shown in FIG. 5A, the button 86 of the clutch mechanism 85 is engaged and is pressed upon by the cover member 37 when the cover member 37 is arranged to close the second housing portion 36. The depressed button 86 releases the clutch mechanism 85 which allows the positioning means 70 to be freely movable by the incoming projectiles via the pushing member 60 in one, for example, clockwise direction; but also in the reverse, counter-clockwise direction under the torsional force of the centrally located resilient member 50 for discharging the projectiles. When the cover member 37 is opened and thus the button 86 is released, as shown in FIG. 5B, the clutch mechanism 85 is engaged to prevent the positioning means 70 from being movable by the torsional force of the resilient member 50, or in other words, to prevent a discharging movement of the received projectiles under the action of the torsional force of the resilient member 50. In this respect, the positioning means 70 is only movable in a clockwise direction to facilitate loading of the projectiles by a user, but not in the reverse, counter-clockwise direction for discharging the loaded projectiles.

It would be appreciated by a skilled person in this relevant art that any alternatives and/or variations to the clutch mechanism, for example, any known engaging mechanisms, such as but not limited to, a locking system actuatable to engage and to stop movement of the positioning means from rotating, shall also be encompassed by the present invention, as long as the skilled person will consider it as being suitable and applicable without departing from the spirit of the present invention. In one embodiment, for example, a locking means such as a position lock (not shown) operably connected with the knob 42 can also be provided to prevent rotation of the positioning means 70 under the biasing force of the resilient member 50. In this embodiment, the position lock can be configured such that it is capable of preventing, stopping or locking rotation of the positioning means 70 only when the knob 42 is manually turned, e.g. in a clockwise direction, to rotate the positioning means 70 all the way to the end of the circular part 40B of the passageway 40 thereby creating room all along the circular part 40B for filling projectiles directly into the second housing portion 36. This is in contrast to the clutch mechanism 85 as previously described, which allows the positioning means 70 be stopped, via the actuation of the knob 42, at any angles of rotation along the circular part 40B for a direct filling of projectiles only at a certain sector of the passageway 40.

Figure 7E:
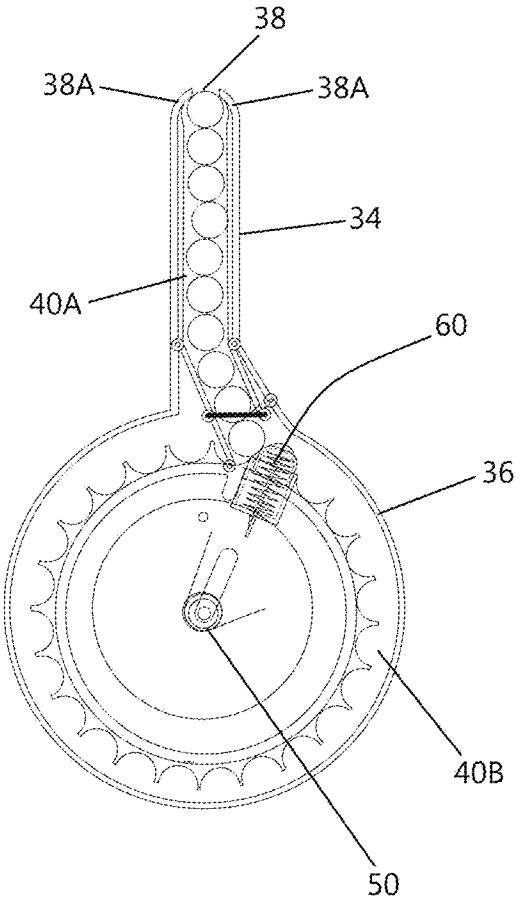
Figure 7F:
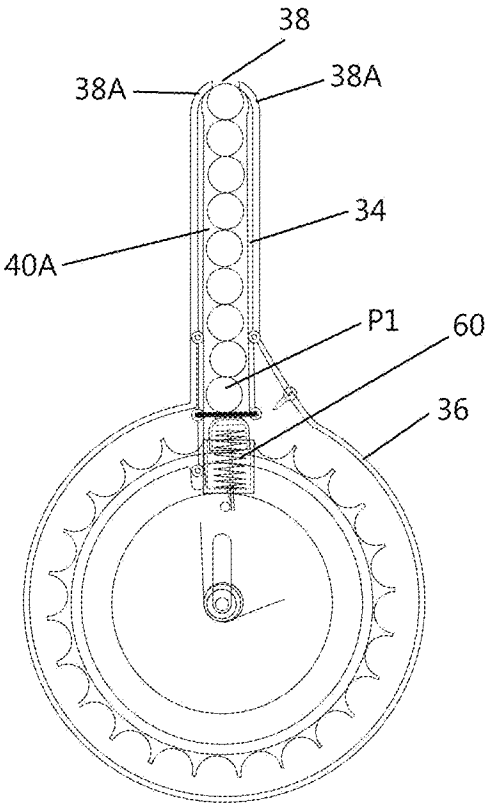
Figure 7G:
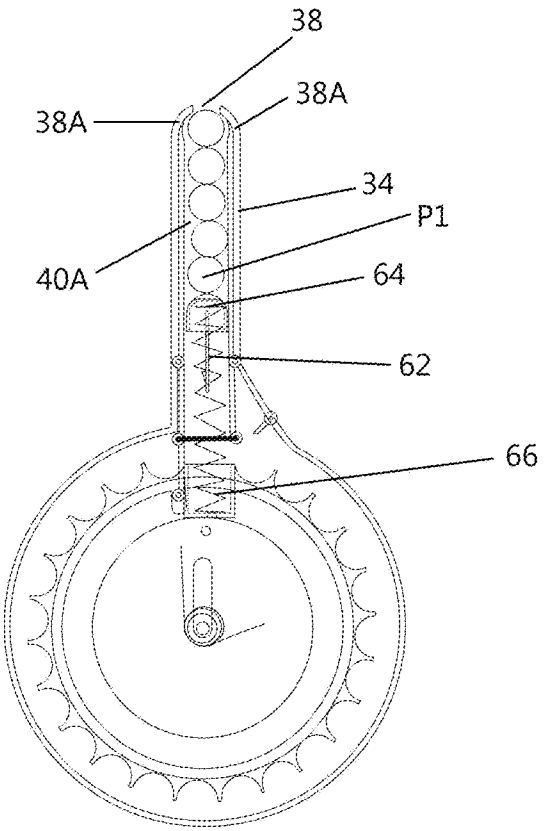
Figure 7H:
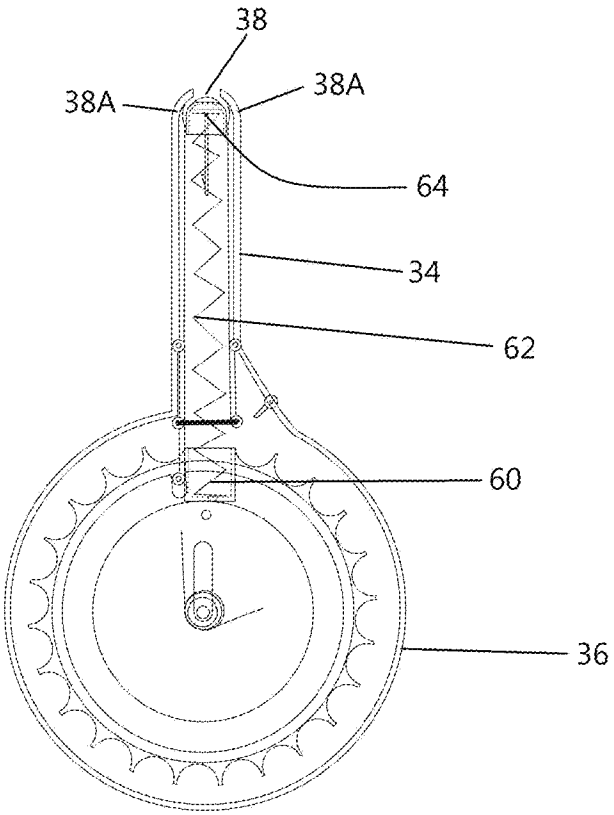

Referring to FIGS. 7A to 7H, shown is a further embodiment of the magazine 30 according to the present invention. In this embodiment, the pushing member 60, or more specifically, the pushing base 66 of the pushing member 60 is fixedly connected at the wheel member 72 of the positioning means 70 at the second housing portion 36, with the pushing head 64 being resiliently extendable and compressible under the action of the resilient means 62. Similar to the previously described embodiments, the pushing member 60 is movable into the circular part 40B of the passageway 40 only when it is compressed to a predetermined threshold, such as in a full compression. As shown in FIGS. 7A(i), 7B(i) and 7C(i), the knob 42 can be actuated, for example, by turning the knob 42 clockwise to rotate the positioning means 70 in a clockwise direction to thereby create room for a direct filling of projectiles into the second housing portion 36. FIG. 7D(i) further shows the magazine 30 after the second housing portion 36 is filled with the projectiles. After the cover member 37 is closed and the clutch mechanism is released, the resilient member 50 is enabled to exert the stored torsional force which causes the positioning means 70 to rotate in a counter-clockwise direction. This counter rotation urges the received projectiles from the circular part 40B of the passageway in the second housing portion 36 to the linear part 40A of the passageway in the first housing portion 34, as shown in FIGS. 7E and 7F, and eventually, discharges the received projectiles one by one via the discharge opening 38. Particularly, once the pushing member 60 is allowed to align with and to re-enter the linear part 40A of the passageway 40 after the discharge of some of the received projectiles in the first housing portion 34, the resilient means 62 extends such that the pushing head 64 is able to continue applying a pressure on the first received projectile P1 and to push the remaining received projectiles towards the discharge opening 38 until the last projectile is discharged, as shown in FIGS. 7G and 7H. FIGS. 7A(ii), 7B(ii), 7C(ii), 7D(ii) further show the corresponding perspective views of the magazine 30 of FIGS. 7A(i), 7B(i), 7C(i), 7D(i).

In one aspect of the present invention, there is provided a toy gun which comprises the magazine 30 as described above. The toy gun can be configured with a receiving or breech portion 22 at the gun body 12 for releasably connecting and/or receiving at least part of the first housing portion 34 of the magazine 30.

In one further aspect of the present invention, there is provided a method of preparing the magazine 30 as described above. The method comprises the steps of providing the housing 32 having the first housing portion 34 and the second housing portion 36 which together define a passageway 40 for receiving a plurality of projectiles. The first housing portion 32 is configured for accommodating the received projectiles in a substantially linear part 40A of said passageway 40, and the second housing portion 36 is configured for accommodating the received projectiles in a substantially circular part 40B of said passageway 40 extending about the central axis A-A of the second housing portion 36. The steps further comprises providing the discharge opening 38 for discharging the received projectiles at the first housing portion 34; and arranging the resilient member 50 centrally at the second housing portion 36 to apply a torsional force to move said received projectiles from the circular part 40B of the passageway 40 in the second housing portion 36 to the linear part 40A of the passageway 40 in the first housing portion 34. The method may further comprise the step of providing the pushing member 60 movably arranged in the passageway 40 of the housing 32 for urging the received projectiles towards the discharge opening 38.

The present invention is advantageous in that it provides a magazine for toy projectiles in which the discharging action can be provided by a centrally arranged resilient member, such as a torsion spring, with the torsion spring being independently operable to provide the required biasing force to discharge the received projectiles. The discharging process can further be assisted by having a pushing member equipped with another resilient means, such as a linear spring means, which is adapted to apply a linear resilient force to push the received projectiles towards the discharge opening. It is important that the torsional resilient member and the linear resilient means of the pushing member are independently operable, which negates the need for a precise matching or fine tuning of the resilience of the two springs during the manufacturing steps. The present invention further provides a cover member operable with a clutch mechanism connecting with the centrally arranged resilient member which allows direct loading or filling of projectiles into the second housing portion. The direct filling of the projectiles into the second housing portion serves as an alternative loading method to that of the one by one insertion of the projectiles via the end opening of the first housing portion, which is useful to facilitate a faster loading of the projectiles and to enhance user experience during play.

The present description illustrates the principles of the present invention. It will thus be appreciated that those skilled in the art will be able to devise various arrangements that, although not explicitly described or shown herein, embody the principles of the invention and are included within its spirit and scope.

Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

While the invention has been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

In the claims hereof, any element expressed as a means for performing a specified function is intended to encompass any way of performing that function. The invention as defined by such claims resides in the fact that the functionalities provided by the various recited means are combined and brought together in the manner which the claims call for. It is thus regarded that any means that can provide those functionalities are equivalent to those shown herein.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A magazine for a toy gun, comprising:

a housing having a first housing portion and a second housing portion which together define a passageway for receiving a plurality of projectiles; the first housing portion being configured for accommodating received projectiles in a substantially linear part of said passageway, and the second housing portion being configured for accommodating the received projectiles in a substantially circular part of said passageway extending about a central axis of the second housing portion;

the first housing portion having a discharge opening for discharging said received projectiles;

a pushing member movably arranged in the passageway of the housing, the pushing member comprising a resilient means adapted to apply a biasing force to abut a first projectile received in the passageway for urging the received projectiles towards the discharge opening; and a resilient member arranged centrally of the second housing portion, wherein said resilient member is adapted to apply a torsional force to move said received projectiles from the circular part of the passageway in the second housing portion to the linear part of the passageway in the first housing portion.

2. The magazine according to claim 1, wherein the resilient member arranged centrally of the second housing portion does not come into operation until the resilient means of the pushing member is compressed to a predetermined threshold.

3. The magazine according to claim 2, wherein the predetermined threshold is a full compression of the resilient means.

4. The magazine according to claim 2, further comprising a switch member adapted to prevent operation of the resilient member before the resilient means of the pushing member is fully compressed.

5. The magazine according to claim 1, wherein the resilient member is adapted to act independently to apply said torsional force to said second housing portion.

6. The magazine according to claim 1, wherein the resilient member arranged at the second housing portion and the resilient means of the pushing member are independently operable.

7. The magazine according to claim 1, wherein the biasing force of the resilient means of the pushing member is weaker than or equal to the torsional force of the resilient member arranged at the second housing portion.

8. The magazine according to claim 1, wherein the resilient means of the pushing member is adapted to be compressed when the pushing member is in the circular part of the passageway provided by the second housing portion.

9. The magazine according to claim 1, wherein the resilient means of the pushing member is adapted to be in an at least partially extended condition when the pushing member is at least partially located in the linear part of the passageway provided by the first housing portion, such that only the pushing member urges the received projectiles towards the discharge opening when the pushing member is in its partially extended condition.

10. The magazine according to claim 1 wherein the resilient means is linearly extendable.

11. The magazine according to claim 1, further comprising a positioning means for positioning the received projectiles at the second housing portion, wherein said positioning means is rotatably movable about the central axis of the second housing portion.

12. The magazine according to claim 11, wherein said positioning means comprises a wheel member having a receiving portion for receiving one or more projectiles.

13. The magazine according to claim 11, wherein said receiving portion comprises a plurality of recesses arranged around a circumferential edge of the wheel member.

14. The magazine according to claim 11, wherein the positioning means is connected to the resilient member such that the positioning means is movable by the torsional force applied by the resilient member to thereby set the received projectiles into movement at the circular part of the passageway.

15. The magazine according to claim 11, wherein at least part of the pushing member is positioned at the positioning means such that the pushing member is movable with the positioning means.

16. The magazine according to claim 1, further comprising a knob actuatable to adjust movement of the received projectiles irrespective of the torsional force of the resilient member.

17. The magazine according to claim 16, wherein the knob is connectable to the resilient member with a clutch mechanism.

18. The magazine according to claim 17, wherein, when the cover member is opened, the clutch mechanism is engaged to prevent movement of the received projectiles under action of the torsional force of the resilient member.

19. The magazine according to claim 16, wherein the knob is connectable to the resilient member with a locking means.

20. The magazine according to claim 1, further comprising a cover member arranged to cover at least the second housing portion of the housing, the cover member being openable to allow direct loading and unloading of one or more projectiles to and from the second housing portion.

21. The magazine according to claim 20, wherein the cover member comprises an open portion to allow the knob as being accessible when the cover member is closed.

22. The magazine according to claim 20, wherein the cover member is hingedly connected at the second housing portion.

23. The magazine according to claim 1, wherein the first housing portion is substantially elongated in shape and the second housing portion is substantially cylindrical in shape.

24. The magazine according to claim 1, wherein the discharge opening at the first housing portion comprises a gate member, the gate member being configured to prevent the projectiles from leaving the first housing portion via the discharge opening unless the magazine is connected with a toy gun for discharge.

25. The magazine according to claim 24, wherein the gate member comprises a pair of curved arms configured to withstand the biasing force from the resilient means of the pushing member.

26. A toy gun comprising the magazine according to claim 1, further comprising a receiving portion at a body of the toy gun for releasably receiving at least part of the first housing portion of the magazine.

27. A method of preparing the magazine according to claim 1, comprising steps of:

providing a housing having a first housing portion and a second housing portion which together define a passageway for receiving a plurality of projectiles; the first housing portion being configured for accommodating received projectiles in a substantially linear part of said passageway, and the second housing portion being configured for accommodating received projectiles in a substantially circular part of said passageway extending about a central axis of the second housing portion;

providing a discharge opening for discharging the received projectiles at the first housing portion;

providing a pushing member movably arranged in the passageway of the housing, the pushing member comprising a resilient means adapted to apply a biasing force to abut a first projectile received in the passageway for urging the received projectiles towards the discharge opening; and arranging a resilient member centrally at the second housing portion to apply a torsional force to move said received projectiles from the circular part of the passageway in the second housing portion to the linear part of the passageway in the first housing portion.

* * * * *